United States Patent [19]

Fillmore

[11] Patent Number: 4,778,071

[45] Date of Patent: Oct. 18, 1988

[54] CLOSURE WITH SNAP TYPE HINGE

[75] Inventor: William E. Fillmore, Toledo, Ohio

[73] Assignee: Owens-Illinois Closure Inc., Toledo, Ohio

[21] Appl. No.: 155,894

[22] Filed: Feb. 16, 1988

[51] Int. Cl.[4] ..... B65D 43/14

[52] U.S. Cl. ..... 215/237; 220/335; 220/339; 222/498; 222/517; 222/556

[58] Field of Search ..... 215/235, 237; 220/339, 220/335; 222/498, 517, 556

[56] References Cited

U.S. PATENT DOCUMENTS

| | | | |
|---|---|---|---|
| 3,628,215 | 12/1971 | Everburg | 220/339 X |
| 3,629,901 | 12/1971 | Wolf et al. | 220/339 X |
| 3,933,271 | 1/1976 | McGhie | 220/339 X |
| 4,047,495 | 9/1977 | O'Brian | 220/306 X |
| 4,386,714 | 6/1983 | Roberto et al. | 215/235 X |
| 4,545,495 | 10/1985 | Kinsley | 215/235 |
| 4,638,916 | 1/1987 | Beck et al. | 215/235 |

*Primary Examiner*—Donald F. Norton

[57] ABSTRACT

A closure with a snap type hinge cap comprising a first part adapted to interengage with the open neck of a container and a second part forming a cap. Each of the first and second parts comprises a base wall and a peripheral skirt. A pair of hinges extends between the skirt of the first part and the skirt of the second part to hinge the parts about a hinge line. A short strap connects the skirt of the first part and the skirt of the second part circumferentially between the hinges. The short strap is axially rigid and has its ends hinged to the skirt of the first part and the skirt of the second part, respectively. The radial length of the strap is less than the length of the arc through which the second cap part is guided for movement by the hinges to and from open and closed positions relative to the first part. The portion of the skirt of the second part to which the strap is connected is capable of flexing. The strap causes the flexing skirt of the second part to deflect while rotating between open and closed positions by pulling the skirt against its normal path. The reaction of the skirt to this pulling action is to tend to force the second part to remain open, or to tend to close the second part after sufficient rotation is made in the closing motion.

6 Claims, 5 Drawing Sheets

CLOSURE WITH SNAP TYPE HINGE

This invention relates to closures and particularly to closures of the type which include a cap that is connected to the remainder of the closure by an integral hinge system.

BACKGROUND AND SUMMARY OF THE INVENTION

It has heretofore been proposed that closures be provided for containers wherein the closures include a cap that is hinged to the part of the closure on the container by an integral hinge. Conventionally, such closures rely on tension and elastic elongation of the hinged components to produce a snap action. Typical constructions are shown in U.S. Pat. Nos. 3,628,215, 3,629,901, 3,933,271, 4,047,495, 4,386,714. U.S. Pat. No. 4,545,495 shows a closure wherein a collar is connected to a cap by a main hinge and connecting elements which are straight when the closure is in closed position and have a non-linear configuration lying in a plane parallel to the main hinge axis when the closure is in open position. The skirt of the cap is elastically deformable adjacent the main hinge so that the skirt bends inwardly when the cap moves from an open position to a closed position.

Among the objectives of the present invention are to provide a dispensing closure which has a cap that operates with a snap action in moving to and from a closed position; which closure does not rely on tension of the hinge; which has minimum hinge protrusion so that it is compatible with high speed filling lines thus allowing greater line speeds; which provides a low profile; and which is relatively easy to manufacture.

In accordance with the invention, the closure with a snap type hinge cap comprises a first part adapted to interengage with the open neck of a container and a second part forming a cap. Each of the first and second parts comprises a base wall and a peripheral skirt. A pair of hinges extends between the skirt of the first part and the skirt of the second part to hinge the parts about a hinge line. A short strap connects the skirt of the first part and the skirt of the second part circumferentially between the hinges. The short strap is axially rigid and has its ends hinged to the skirt of the first part and the skirt of the second part, respectively. The radial length of the strap is less than the length of the arc through which the second cap part is guided by movement by the hinges to and from open and closed positions relative to the first part. The portion of the skirt of the second part to which the strap is connected is capable of flexing. The strap causes the flexing skirt of the second part to deflect while rotating between open and closed positions by pulling the skirt against its normal path. The reaction of the skirt to this pulling action is to tend to force the second part to remain open, or to tend to close the second part after sufficient rotation is made in the closing motion.

DESCRIPTION

Figure 1:
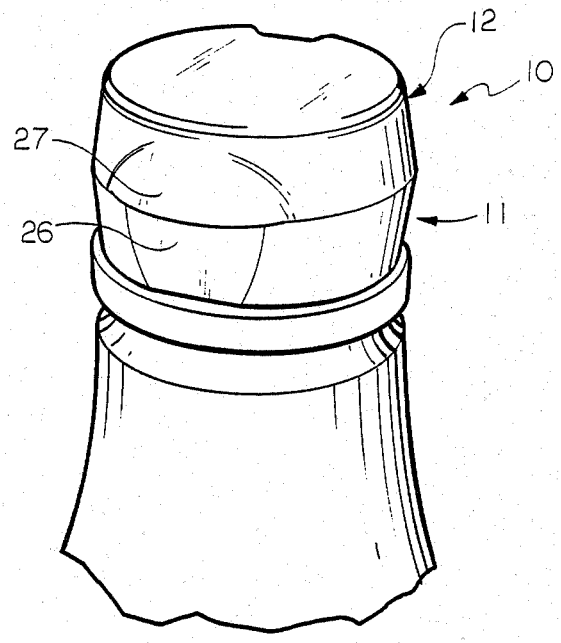
FIG. 1 is a fragmentary perspective view of a closure and container embodying the invention.
Figure 2:
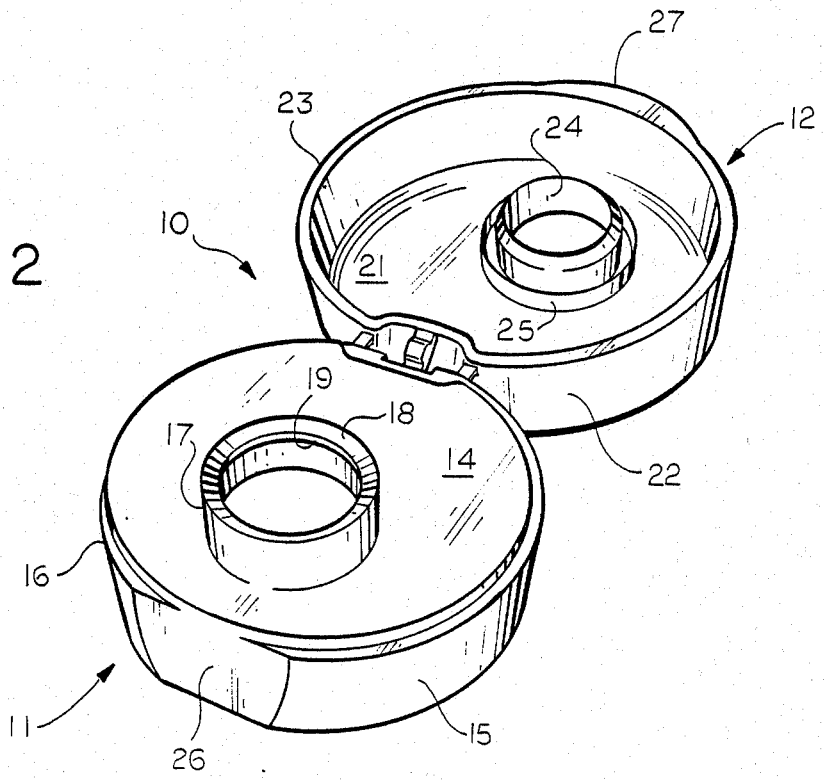
FIG. 2 is a perspective view of the closure in open position.
Figure 3:
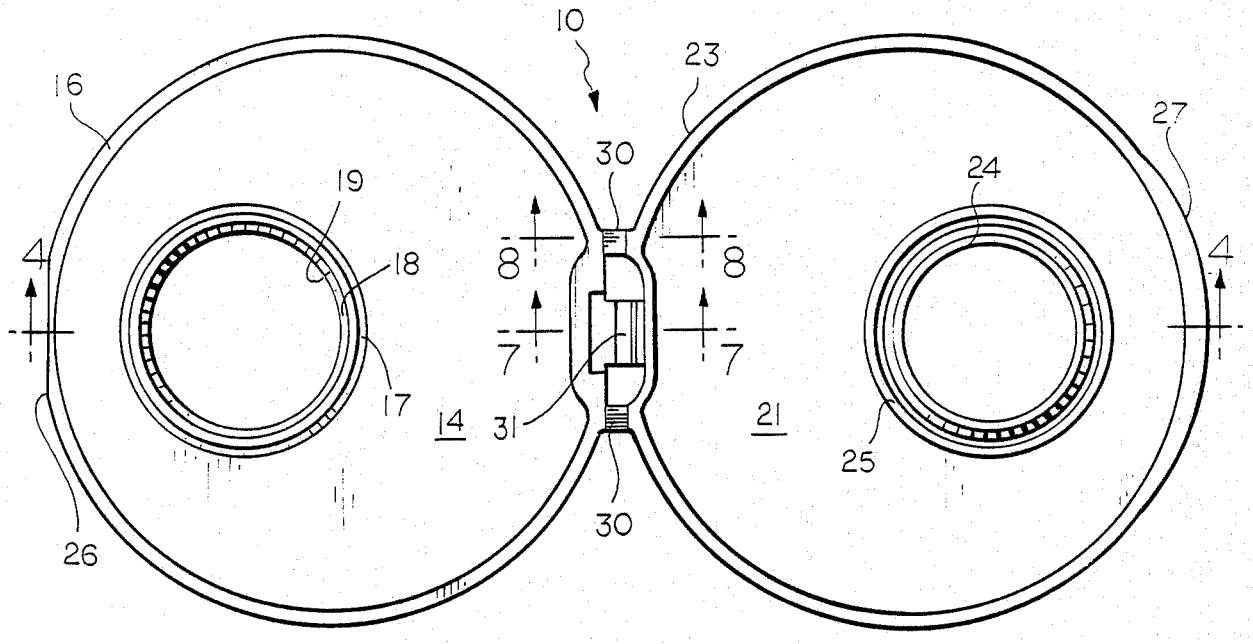
FIG. 3 is a plan view of the closure in open position.
Figure 4:
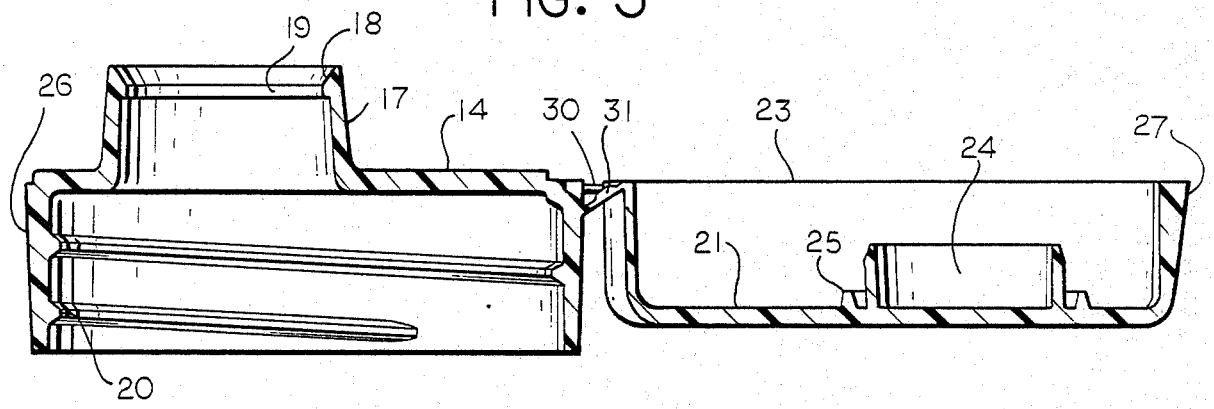
FIG. 4 is a sectional view taken along the line 4—4 in FIG. 3.
Figure 5:
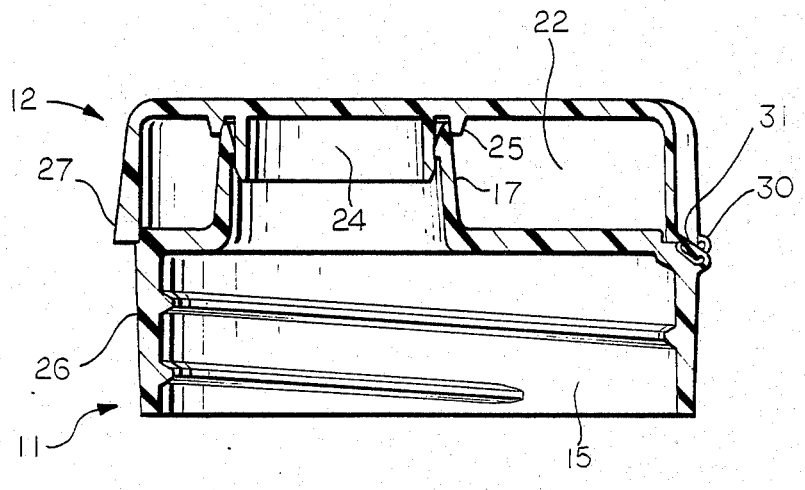
FIG. 5 is a sectional view taken along the line 5—5 in FIG. 6.
Figure 6:
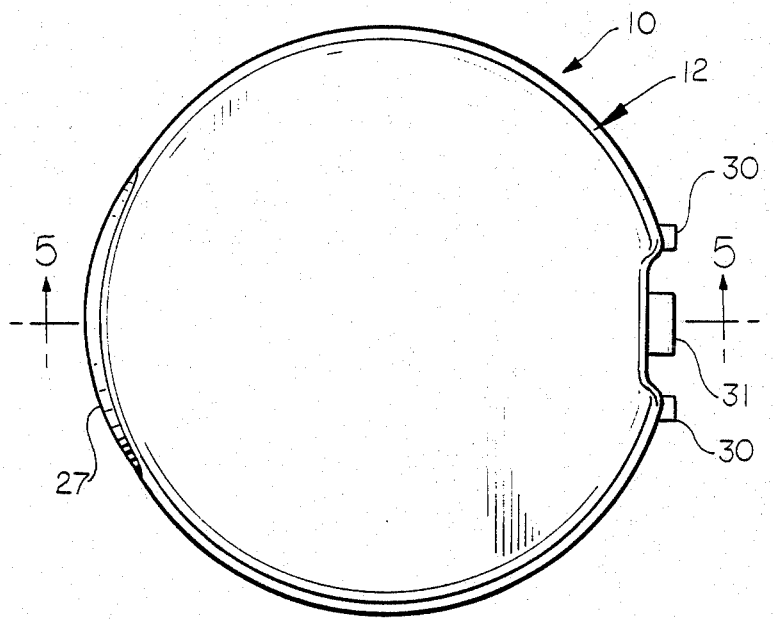
FIG. 6 is a plan view of the closure in closed position.
Figure 8:
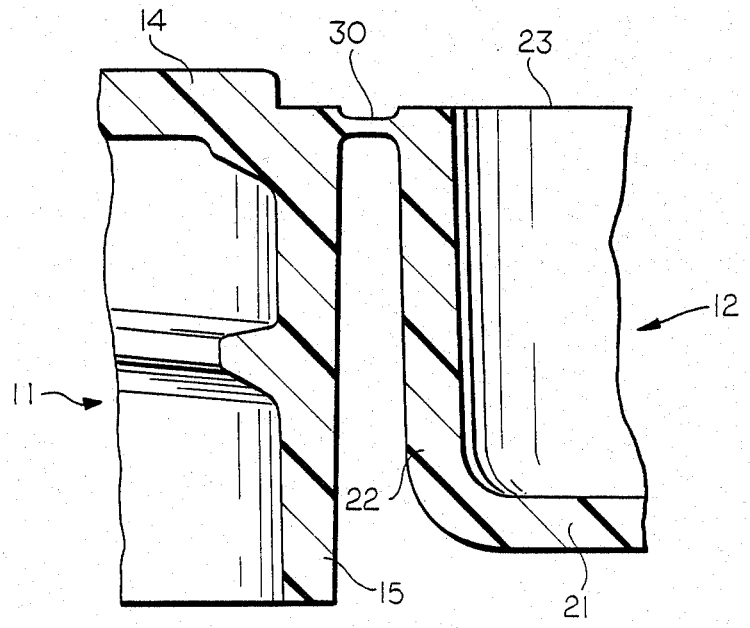
FIG. 8 is a fragmentary sectional view on an enlarged scale taken along the line 8—8 in FIG. 3.

Referring to FIGS. 1–10, the closure 10 embodying the invention is made of plastic such as polypropylene and comprises a first part 11 which is adapted to be threaded on the neck of a container C and a second part 12 which forms a cap and hinged to the first part 11.

The first part 11 includes a base wall 14 and a peripheral skirt 15 with a shoulder 16 at the juncture of the base wall 14 and skirt 15. A tubular spout 17 extends from the exterior surface of base wall 14 and terminates in a chamfer rim 18. An annular bead 19 is formed on the inner surface of the spout 17. The skirt 15 is formed with an internal thread 20 on the inner surface thereof for engagement with the threads on the neck of a container C. The spout 17 provides a dispensing outlet for the contents of a container on which the closure is applied.

The second or cap part 12 is formed with a base wall 21 and a peripheral skirt 22. Shoulder 16 is adapted to be engaged by the free edge 23 of the skirt 22. Spaced concentric walls 24, 25 are provided on the inner surface of the base wall 21 and are adapted to telescope over the spout 17 and receive the spout 17 in the annular space formed between walls 24, 25 when the cap is moved to closed position. The wall 25 is axially shorter than the wall 24 to permit the swinging movement of the cap 12 into position for engagement of the wall 24 with the spout 17. Chamfer rim 18 guides the inner wall 24 into the opening of the spout 17. The inner diameter of the outer wall 25 is slightly less than the outer diameter of the spout 17 near the rim 18 such that the wall 25 engages and seals against the outer surface of the spout 17. Bead 19 provides a friction fit for innermost wall 24 to both insure a tight seal for the contents of the container and clean the spout of contents in the region adjacent rim 18. The friction fit also secures the second part 12 in closed position.

Peripheral skirt 15 of the first part 11 is formed with a flattened external surface 26 that underlies a portion 27 on the skirt 22 of the second part 12 so that the portion 27 can be engaged by the thumb or finger of the user to open the closure. The portion 26 extends circumferentially and blends into the skirt 15 so that the cap part 12 is less likely to pop out and interfere with capping or case packing of the closed container.

A pair of integral flexible hinges 30 extend between adjacent portions of the first part 11 and second cap part 12 from the area of juncture of the skirts 15, 22 and their respective base walls 14 and 21. Hinges 30 flex without any substantial stress and form the hinge line between the parts 11 and 12. A short relatively rigid strap 31 connects the skirts 15, 22 between hinges 30 along a radial line. Strap 31 is relatively rigid and is connected to the skirt 15 of part 11 by an integral thinner flexible hinge 32 and to the portion 34 of skirt 22 of part 12 by an integral flexible thinner hinge 33.

Figure 7:
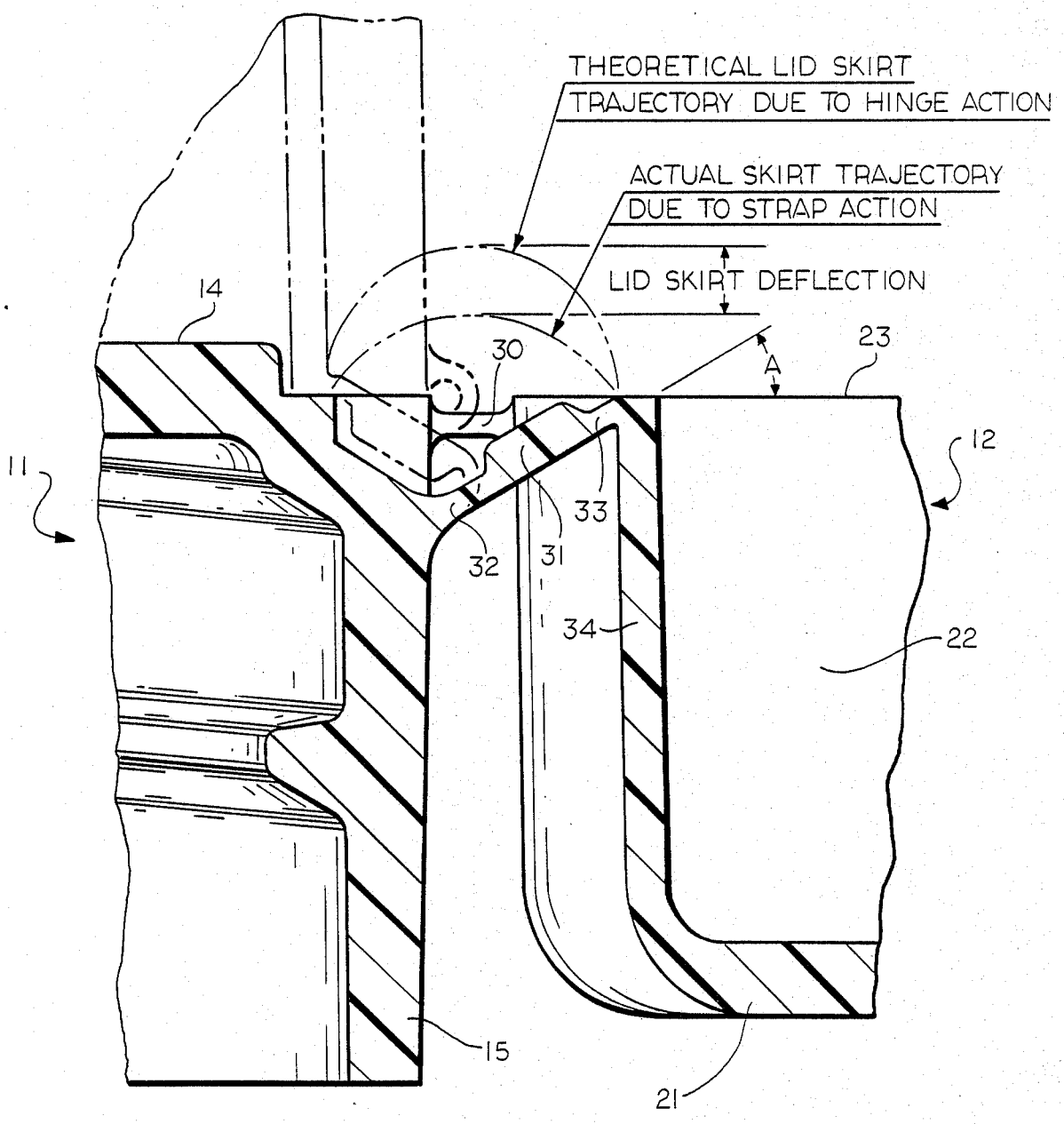
FIG. 7 is a fragmentary sectional view on an enlarged scale taken along the line 7—7 in FIG. 3.
Figure 9:
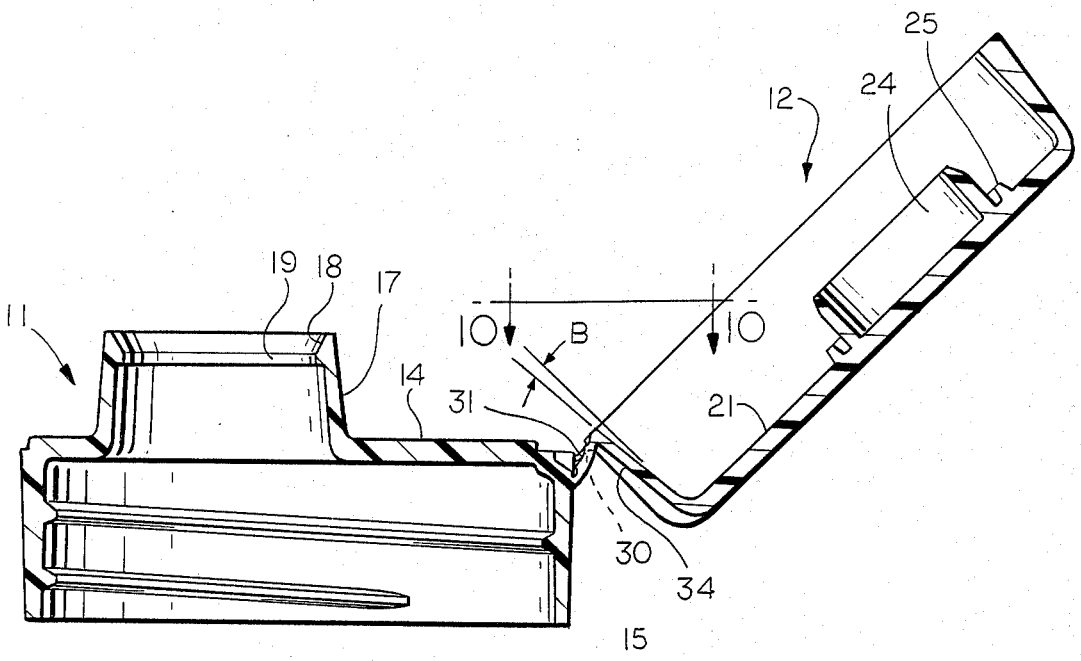
FIG. 9 is a sectional view similar to FIG. 4 showing the relative positions of the parts in an intermediate position between open and closed positions.
Figure 10:
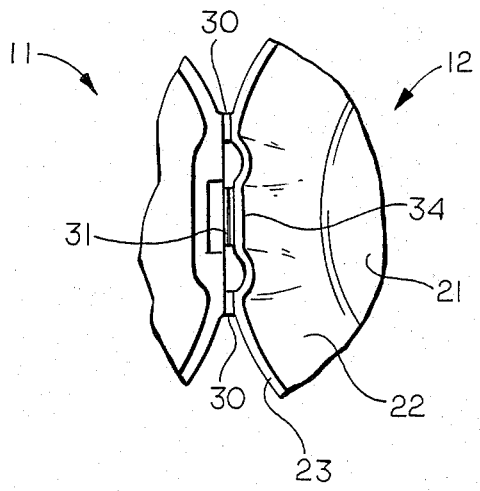
FIG. 10 is a fragmentary view taken along the line 10—10 in FIG. 9.

Strap 31 is hinged to skirt 15 at a point spaced axially from the hinge point of hinges 30 to the skirt 15. Strap 31 is hinged to skirt portion 34 at a point lying on the plane containing the points of attachment of hinges 30 to the skirt 22. As a result when the part 11 is open, as shown in FIG. 7, and the axes of the parts are parallel, the strap forms an acute angle A with a plane containing the free edge of skirt 22 and hinges 30. The radial length of strap 31 is less than the radius of the arc through which the second cap part 12 is guided for movement by the hinges 30 to and from an open and closed position (FIG. 7). The adjacent wall portion 34 of the cap part 12 is thinner than the remainder of the skirt 22 such that the strap 31 flexes the wall portion 34 radially outwardly, as shown in FIGS. 9 and 10, through an angle B (FIG. 9) and the wall portion 34 functions as a sole spring tending to move the cap part 12 to open or close the cap part 12. Strap 31 causes wall portion 34 of cap part 12 to deflect while rotating between open and closed positions by pulling the skirt against its normal path. The reaction of the skirt to this pulling action is to tend to force the second part to remain open, or to tend to close the second part after sufficient rotation is made in the closing motion.

Referring more specifically to FIGS. 9 and 10 as the closure is moved from open to closed position, the strap 31 is placed under tension and since it has a length less than the arc through which the parts move, it flexes the thin wall portion 34 radially outwardly relative to the part 12 to the position shown in FIG. 10. At the point of maximum tension in the strap 31, the spring force provided by flexing of the wall portion 34 provides a stress tending to move the cap part 12 toward the closed position. When the part is moved toward an open position, the same condition is reached wherein the wall portion 34 is flexed in the movement of the cap part 12 toward the open position.

I claim:

1. A closure with a snap type hinge cap comprising
a first part adapted to interengage with the open neck of a container,
a second part forming a cap,
each of the first and second parts comprising a base wall and a peripheral skirt,
a pair of integral hinges extending from the skirts,
an integral strap extending from said skirts and along a radial line between said hinges,
said strap being relatively rigid in a longitudinal direction and being connected to the skirts by relatively thin integral hinges,
the radial length of said strap being less than the radius of the arc through which the second part is guided by movement by the hinges to and from open and closed positions such that a wall portion of one of said skirts is flexed radially outwardly and functions as a sole spring urging said first part toward and from open and closed positions.

2. The closure set forth in claim 1 wherein said portion of said skirt of said second part is thinner than the remainder of said skirt to facilitate radial flexing.

3. The closure set forth in claim 1 wherein said strap is of generaly uniform thickness between said thin hinges.

4. The closure as set forth in claim 1 wherein said strap is hinged to the skirt of the first part at a point spaced axially from the points of attachment of the hinges to the skirt of the first part.

5. The closure as set forth in claim 4 wherein said hinges are in a plane generally parallel to the first edge of the skirt of the second part.

6. The closure as set forth in claim 5 wherein said hinge point of said strap to the skirt of said second part and said hinges are in substantially the same plane when said second part is in fully open position relative to said first part.

* * * * *